US006631701B2

(12) United States Patent
Seader et al.

(10) Patent No.: US 6,631,701 B2
(45) Date of Patent: Oct. 14, 2003

(54) CAMSHAFT LUBRICATION SYSTEM

(76) Inventors: Mark E. Seader, 737 McGraw Cir., Fort Collins, CO (US) 80526; Thomas E. Ehresman, 616 N. Colorado Ave., Loveland, CO (US) 80537

( * ) Notice: Subject to any disclaimer, the term of this patent is extended or adjusted under 35 U.S.C. 154(b) by 0 days.

(21) Appl. No.: 09/919,082

(22) Filed: Jul. 31, 2001

(65) Prior Publication Data

US 2002/0020379 A1 Feb. 21, 2002

Related U.S. Application Data

(60) Provisional application No. 60/222,277, filed on Jul. 31, 2000.

(51) Int. Cl.[7] ..... F01M 1/06

(52) U.S. Cl. ..... 123/90.34; 123/90.33; 123/90.6; 123/196 R; 184/6.5; 74/567

(58) Field of Search ..... 123/90.33, 90.34, 123/196 R, 196 M, 90.6; 184/6.5; 74/567

(56) References Cited

U.S. PATENT DOCUMENTS

| | | | | |
|---|---|---|---|---|
| 1,175,720 A | * | 3/1916 | Delaunay-Belleville | 123/90.34 |
| 1,469,063 A | * | 9/1923 | Willis | 123/90.34 |
| 1,497,503 A | * | 6/1924 | Greuter | 123/90.34 |
| 3,033,314 A | * | 5/1962 | Wetterhahn | 184/6.9 |
| 3,628,513 A | | 12/1971 | Grosseau | 123/90.34 |
| 3,958,541 A | | 5/1976 | Lachnit | 123/90.34 |
| 4,329,949 A | | 5/1982 | Abts et al. | 123/90.34 |
| 4,343,270 A | | 8/1982 | Kawabe | 123/196 |
| 4,537,166 A | | 8/1985 | Kimura et al. | 123/90.36 |
| 4,615,310 A | | 10/1986 | Umeha et al. | 123/90.34 |
| 4,957,079 A | * | 9/1990 | Nakatani et al. | 123/90.34 |
| 4,991,549 A | | 2/1991 | Sugiura | 123/90.27 |
| 5,186,129 A | * | 2/1993 | Magnan et al. | 123/90.34 |
| 5,309,878 A | | 5/1994 | Kandler et al. | 123/196 M |
| 5,404,845 A | * | 4/1995 | Hannibal et al. | 123/90.16 |
| 5,450,665 A | | 9/1995 | Madono et al. | 29/888.1 |
| 5,778,841 A | * | 7/1998 | Reedy et al. | 123/90.34 |
| 6,173,689 B1 | | 1/2001 | Tanaka | 123/90.34 |
| 6,227,155 B1 | * | 5/2001 | Tosaka et al. | 123/90.34 |

FOREIGN PATENT DOCUMENTS

| | | |
|---|---|---|
| JP | 55-037552 | 3/1980 |
| JP | 55-132417 | 10/1980 |

OTHER PUBLICATIONS

"AVCO Lycoming 0–360–A Series Parts Catalog", AVCO, Fig. 3, p. 1.6 (1999).

"Camshaft Group", Teledyne Continental Motors, Aircraft Parts Division, Fig. 05.01, pp. 0501 and viii (1995).

* cited by examiner

*Primary Examiner*—Thomas Denion
*Assistant Examiner*—Ching Chang
(74) *Attorney, Agent, or Firm*—Santangelo Law Offices; Craig Miles

(57) ABSTRACT

A hollow camshaft (19) lubrication system for aircraft engines that supplies lubricant (14) to cam lobe surfaces (25) from the interior surface (22) of the hollow camshaft (19) even during periods when aircraft operation moves the rotation axis of the hollow camshaft (19) from horizontal.

10 Claims, 6 Drawing Sheets

A—A'

CAMSHAFT LUBRICATION SYSTEM

This application claims the benefit of U.S. Provisional Application No. 60/222,277 filed on Jul. 31, 2000, hereby incorporated by reference herein.

BACKGROUND OF THE INVENTION

Specifically, a camshaft system for aircraft engines configured to provide a camshaft lubrication system that enhances the transfer of lubricant to camshaft surfaces even when the aircraft is operated in a manner that locates the rotation axis of the hollow camshaft from horizontal. Generally, an enhanced camshaft lubrication system for hollow camshafts rotationally journaled in a plurality of bearings.

Camshaft systems in aircraft engines are difficult to lubricate. Conventional aircraft engine technology utilizes valves that are operationally responsive to rotating cam surfaces on a camshaft rotationally journaled in a plurality of bearings. The complicated movements of the camshaft and valve systems make the journaled surfaces and the cam surfaces of the camshaft subject to wear during engine operation. Especially, contact between the cam lobe surface and the mating lifter face, tappet, rocker arm, or the like can be subject to an extremely high loading. This high load between the contact surfaces makes fluid lubrication of the sliding surfaces difficult requiring the use of high pressure additives to lubricants.

As a result, conventional aircraft camshaft lubrication technology may be insufficient to prevent frictional power loss, or prevent damage to the cam surfaces, such as pitting, spalling, scuffing, or the like, of the slidingly engaged surfaces. The subsequent failure of the camshaft systems in aircraft engines due to a lack of lubrication at critical times in the camshaft operating cycle has been documented. Firewall Forward Technologies Technical Report No. 1, Firewall Forward Technologies 5212 Cessna Drive, Loveland, Colo. 80538, hereby incorporated by reference herein.

Because there is a large commercial demand for enhanced lubrication systems to resolve the problem of insufficient lubrication of camshaft components during such critical times in the camshaft operating cycle, various types of conventional engine and camshaft lubrication systems have been developed. However, even in light of existing commercial demand and the variety of conventional lubrication technologies that have been developed over the years, significant problems remain unresolved in providing camshaft lubrication technology that provides sufficient lubrication to camshaft components during operation of aircraft engines.

As shown by U.S. Pat. No. 4,991,549, hereby incorporated by reference herein, a conventional method of lubricating camshaft surfaces may be by configuring the cylinder head of the engine to provide "wells" or catch areas in which the lubricant can collect. A significant problem with well type technology may be that the lubricant collected in the wells or catch areas is unfiltered lubricant. As such, the wells or catch areas may accumulate particulate or debris from the unfiltered lubricant. The particulate or debris may then be transferred to the cam lobe surfaces resulting in wear or damage to these surfaces. Another significant problem with well or catch area technology may be that the lubricant migrates in response to the orientation of the engine or the acceleration of the aircraft. As such, the amount of lubricant collected in a particular location may vary significantly depending on the engine orientation (pitch, roll, or yaw) or the acceleration of the aircraft. As the lubricant migrates in response to orientation of the engine or acceleration the amount of lubricant available for transfer to the cam lobes, the amount of lubricant actually transferred to the surface of the cam lobes, or the placement of the lubricant with respect to the cam lobe surface may vary during the operation of the engine. An additional problem with well or catch area technology may be that the oil collected in the wells may be hot. As lubricant circulates through an engine during operation the temperature of the lubricant rises. By the time it is collected in a well or catch area, the lubricant may be sufficiently hot that the lubrication properties of the oil are diminished. A further problem with well or catch area lubrication technology may be the lubricant may not collect or transfer properly to the cam lobe surfaces when the lubricant is cold. Because cold lubricants may exhibit high flow resistance, a cold lubricant may not collect readily into wells or catch areas. As such, there may be little lubricant or a reduced amount of lubricant for transfer to the cam lobe surfaces and little or no lubricant may actually be transferred to the cam lobe surfaces when the engine is started cold.

Similarly, as shown by U.S. Pat. Nos. 4,329,949 and 4,343,270, each hereby incorporated by reference herein, a conventional method of lubricating camshaft surfaces may be to configure the cylinder head, the cylinder head cover, or other engine component to collect excess lubricant so that it may drip onto the cam lobe surfaces. As above, the lubricant may be unfiltered and transfer particulate or other debris to the cam lobe surfaces resulting in unnecessary wear to such surfaces, the amount of lubricant available for transfer to the cam lobe surfaces or the amount actually transferred to the cam lobe surfaces may vary depending on the migration of the lubrication in response to orientation of the engine or the acceleration of the aircraft, the lubricant may have been preheated to a high temperature prior to being dripped onto the cam lobe surfaces, or the lubricant may fail to collect or drip onto the cam lobe surfaces properly when cold.

Another conventional method of lubricating camshaft surfaces may be to spray lubricant onto the camshaft surfaces as disclosed by U.S. Pat. Nos. 6,173,689; 3,628,513; 3,958,541; and 4,343,270, each hereby incorporated by reference herein. In addition to the significant problems discussed above, a further significant problem with spraying lubricant onto camshaft surfaces can be that it results in high oil consumption. As lubricant is sprayed a portion of the lubricant can remain in suspension or mist for a sufficiently long duration and in amounts that may overwhelm the lubricant separator system. The lubricant would then be driven from the engine through the crankcase breather system. Another significant problem with spraying lubricant may be low lubricant pressure or the necessity of increasing the capacity of the lubricant pump. In aircraft, size and weight restrictions may make additional or larger components impractical or impossible to incorporate. Moreover, aircraft engine design and safety specifications are regulated by the federal law which may prohibit the use of spray type technology in aircraft. For example, the usable oil tank capacity may not be less than the product of the endurance of the airplane under critical operation conditions and the maximum oil consumption of the engine under the same conditions, plus a suitable margin to ensure adequate circulation and cooling. 14 C.F.R. §23.1011(c), hereby incorporated by reference herein.

Another conventional method of lubricating camshaft surfaces may be to supply lubricant to the hollow interior of the camshaft and then subsequently deliver the lubricant to the exterior surface of the camshaft as disclosed by U.S. Pat.

Nos. 5,450,665; 4,615,310; and Japanese Abstract No 5503755A, each hereby incorporated by reference herein. A significant problem with utilizing the interior of hollow camshafts to deliver lubricant to the cam lobe surfaces may be that lubricant supplied to the interior of the hollow camshaft is not uniformly distributed over the interior surface of the hollow camshaft. As disclosed by Japanese Abstract No. 5503755A, a single feed hole at the drive end of a camshaft (or a single feed hole to the camshaft interior from the drive end bearing) supplies the lubricant to the interior of the camshaft to be distributed to all the cam lobe surfaces and all the camshaft bearings. When lubricant is supplied to the interior of a hollow camshaft through a single feed hole it can take a duration of time for a layer of lubricant to form over the entire interior surface of the camshaft (or may not form at all as to some surface area) after the engine is started. As a result, lubricant supply ducts distal from the single feed may not deliver lubricant to the cam surfaces during engine operation. As such, various attempts have been made to reduce the interior volume of hollow camshafts. For example, the filler elements disclosed by U.S. Pat. No. 4,615,310; and Japanese Abstract Nos. 55-132417 and 57-75105, each hereby incorporated by reference. The failure to deliver sufficient lubricant to the interior of the camshaft or the failure to deliver sufficient lubricant to the exterior surfaces of the camshaft during operation may be exacerbated when the rotation axis of the camshaft is not horizontal. For example, when conventional hollow camshaft technology is operated at twenty degrees attitude, lubricant may only be delivered to the portion of the hollow interior of the camshaft proximate to the lubricant feed hole. Because aircraft routinely operate at attitudes (pitch, roll, yaw) which require the camshaft to operate for a duration of time out of the horizontal position (takeoff, landing, ascent, descent, turns, or so forth) conventional camshaft lubrication technology may not provide sufficient lubricant to all the cam lobe surfaces.

Another significant problem with conventional hollow camshaft lubrication technology may be that the feed holes supplying lubricant to the interior of the hollow camshaft and the lubricant delivery ducts to the cam lobe exterior surface do not have the proper angular displacement. The stream of lubricant supplied to the interior of a camshaft under pressure can disturb the lubricant layer or flow of lubricant on the interior surface of the hollow camshaft as shown by FIG. 5. When the lubricant feed hole is located approximately opposite the lubricant delivery hole to the cam lobe surfaces the lubricant entering the interior of the camshaft may disturb the lubricant pooled on the opposite side of the interior surface of the camshaft and prevent or impede lubricant from entering the lubricant delivery hole to the cam lobe surfaces. As such, the cam surface may not be supplied with a sufficient amount of lubricant to prevent damage.

Another significant problem with conventional hollow camshaft lubrication technology may be that lubricant layer or lubricant stream may be insufficient to supply lubricant to multiple lubricant delivery holes. A first lubricant delivery hole may utilize the entire amount of lubricant that flows over it. As such, a second lubricant delivery hole positioned to take advantage of the same portion of the lubricant stream or lubricant flow as the first lubricant delivery hole may not receive an adequate supply of lubricant.

Another significant problem with conventional hollow camshaft lubrication technology may be that modifications to increase the amount of lubricant to the cam lobe surfaces, such as increasing the aperture size, can overtax standard lubricant pressurization pumps. The subsequent reduction in lubricant pressure may result in insufficient delivery of lubricant to the exterior surfaces of the modified camshaft. See, Firewall Forward Technologies Technical Report No. 2, hereby incorporated by reference herein.

Another significant problem with conventional hollow camshaft lubrication technology may be that there is not a vent hole in the hollow camshaft. The absence of a vent hole can prevent or impede moisture or lubricant vapor, gases, or the like, from being transferred from the interior volume of the camshaft. As such, increased pressure in the interior of the hollow camshaft must be transferred from the lubrication supply ducts to the exterior surfaces of the cam lobes. Relieving pressure through these supply ducts may interrupt the continuous flow of lubricant from the lubricant supply duct to the cam lobe surface.

With respect to each of the above-described problems with conventional camshaft lubrication technology, and specifically with respect to the problems with the use of conventional camshaft lubrication technology in the context of aircraft engines, the present invention discloses camshaft lubrication systems that address each in a practical fashion. The invention also satisfies the long felt but unresolved need for a reliable camshaft lubrication system for aircraft engines. Moreover, while the instant description provides numerous examples of the invention in the context of aircraft and aircraft engines, it is understood that the inventions disclosed may be used in a wide variety of applications, including but not limited to, automobile engines, marine engines, motorcycle engines, high performance engines, or the like.

SUMMARY OF THE INVENTION

Accordingly, a broad object of embodiments of the invention is to provide a camshaft lubrication system that provides both camshaft apparatuses and camshaft lubrication methods that may be used in aircraft engines, or used in other types of engines such as automobiles, boats, motorcycles, or the like.

Another broad object of embodiments of the invention can be to provide camshaft apparatuses and methods of lubricating camshafts that can be used in a wide variety of valve mechanism applications, such as, valve mechanisms that are responsive to tappets, lifters, rocker arms, or the like; or when the camshaft is located overhead cam; or the camshaft employs push rods; or used in conjunction with hydraulic lash adjusters, or the like.

Another broad object of embodiments of the invention can be to provide camshaft apparatuses and methods of lubricating camshafts for engines that operate the camshaft at various amounts of pitch, roll, or yaw, such as a pitch of 5 degrees, 10 degrees, 15 degrees, 20 degrees, or more from horizontal.

Another broad object of embodiments of the invention can be to provide camshaft apparatuses and camshaft lubrication methods that can replace factory specification camshafts approved for use in airplane engines such as Continental or Lycoming aircraft engines, for example.

Another broad object of embodiments of the invention can be to provide camshaft apparatuses and camshaft lubrication methods that provide a sufficient lubrication layer to form on the interior surface of hollow camshafts to provide sufficient lubricant to each cam surface lubrication supply duct.

Another broad object of embodiments of the invention can be to provide camshaft apparatuses and camshaft lubrication methods that provide proper angular displacement of the camshaft lubrication supply ducts and the cam surface lubrication supply ducts so that lubricant entering the interior of the camshaft does not disrupt the delivery of lubricant to proximate lubrication supply ducts.

Another broad object of embodiments of the invention can be to provide a camshaft apparatuses and camshaft lubrication methods that provide proper angular displacement of multiple cam surface lubrication supply ducts so that lubricant flow over the first duct does not disrupt or impede the flow of lubricant to the remaining ducts.

Another broad object of embodiments of the invention can be to provide camshaft apparatuses and camshaft lubrication methods that provide proper ventilation of the interior volume of a hollow camshaft.

Another object of embodiments of the invention can be to provide a reduced wear camshaft apparatus.

Naturally further objects of the invention are disclosed throughout other areas of the specification and claims.

DETAILED DESCRIPTION OF THE PREFERRED EMBODIMENTS

An aircraft camshaft lubrication system invention including aircraft camshaft apparatuses and methods of lubricating an aircraft camshaft as disclosed by the description below and by reference to the accompanying figures.

Figure 1:
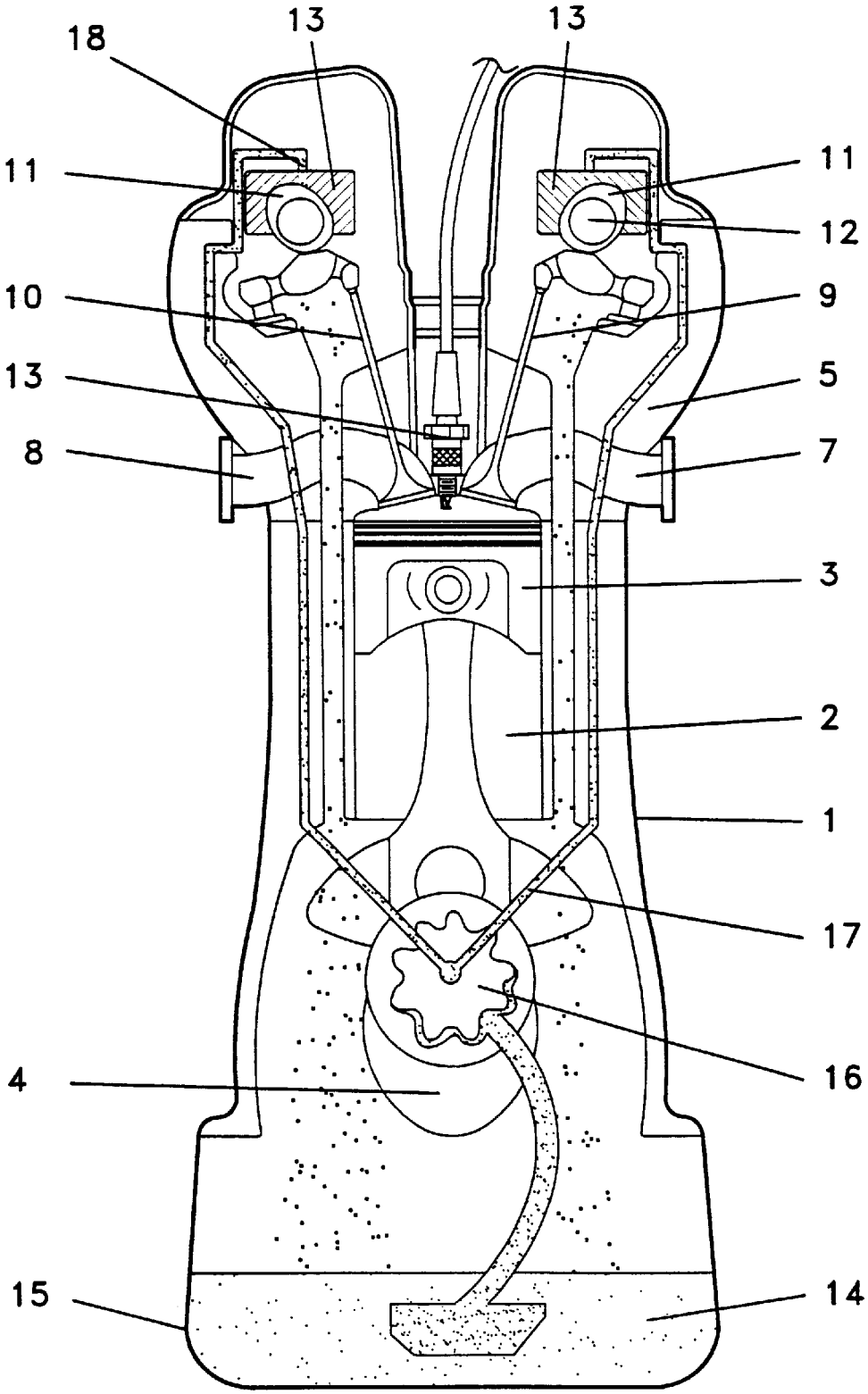
FIG. 1 shows an embodiment of the camshaft lubrication invention in a generic reciprocating piston engine.

Now referring primarily to FIG. 1, the camshaft lubrication system invention can be utilized in an aircraft engine. While FIG. 1 shows the camshaft invention utilized in a generic overhead cam engine, the camshaft invention can be utilized with other valve mechanism configurations, such as conventional push rod or rocker arm valve operated valve mechanisms. As such, the figure is not intended to limit the invention to use in overhead cam engines but rather to provide sufficient disclosure to allow an individual to make and use the invention in the context of a wide variety of engine applications (automotive, marine, or the like), and specifically aircraft engines.

An embodiment of the invention can comprise an airplane (not shown) having an aircraft engine comprising a block (1) with at least one cylinder (2). A reciprocal means (3), such as a piston, can be slidingly engaged to the surface of the cylinder (2). A reciprocal movement to rotational movement conversion element (4), such as a crankshaft, can be rotatably coupled to the reciprocal means (3) and rotationally journaled to the block (1). A cylinder head (5) can be coupled to the block to enclose the volume of the cylinder (2) and make the reciprocal means (3) responsive to changes in pressure within the cylinder (2). At least two conduits (7) (8) can traverse the cylinder head (5) to fluidicly couple the volume of the cylinder (2) to a fuel source (not shown) and to the atmosphere respectively. At least one valve (9)(10) is coupled to each of the two conduits (7)(8) to regulate the flow of fuel into and fuel combustion products out of the cylinder (2). Each valve can be made operationally responsive to the rotation of a camshaft lobe (11) coupled to a hollow shaft (12) rotationally journaled to a plurality of bearing means (13). The shape, orientation, and rotation speed of the cam lobe(s) (11) can be adjusted to open and close the intake valve (9) and the exhaust valve (10) to correspond to the reciprocal movement of the reciprocal means (3). The cam lobe can be adjusted to allow intake valve (9) to open during the down stroke of the reciprocal means (3) in the cylinder (2). Fuel can be drawn from a fuel system (not shown) into the cylinder (2) through a first conduit (7). The cam lobe (11) continues to rotate allowing the intake valve (9) to close. The fuel drawn into the cylinder (2) is compressed by the upstroke of the reciprocal means (3) and is ignited by an ignition element (13) and the expanding gases from the combustion of the fuel propel the reciprocal means (3) into the next down stroke. On the subsequent upstroke of the reciprocal means (3) in the cylinder (2) the cam lobe (11) corresponding to the exhaust valve (10) opens the valve to allow the combustion products of the fuel or exhaust to exit through the second conduit (8) to the atmosphere. The reciprocal movement to rotational movement conversion element (4) can be made to rotate the propeller of an aircraft (not shown), or power various other types of devices.

While this sequence of events describes the power generation cycle in a generic four stroke engine, the invention can generally be used in two stroke power generation cycles as well. Naturally, the camshaft configuration and rotation speed will vary depending on the number, size, and stroke length of the reciprocal means (3); the location of the camshaft within the engine; the configuration and type of valve mechanism utilized; the number of strokes in the power generation cycle; or the like. The camshaft lubrication invention described can be utilized in the numerous permutations and combinations of these components.

To reduce the friction between slidingly engaged surfaces, lubricant (14) can be supplied to a lubricant reservoir (15). While some of the lubricant is delivered to some of the slidingly engaged surfaces by random splash, lubrication of slidingly engaged surfaces can be enhanced by drawing lubricant (14) from the lubricant reservoir (15) with a lubricant pressurization element (16) and delivering the lubricant (14) through lubrication conduits (17) to the various slidingly engaged surfaces, including but not limited to, the camshaft journals and the camshaft lobes (11).

Figure 2:
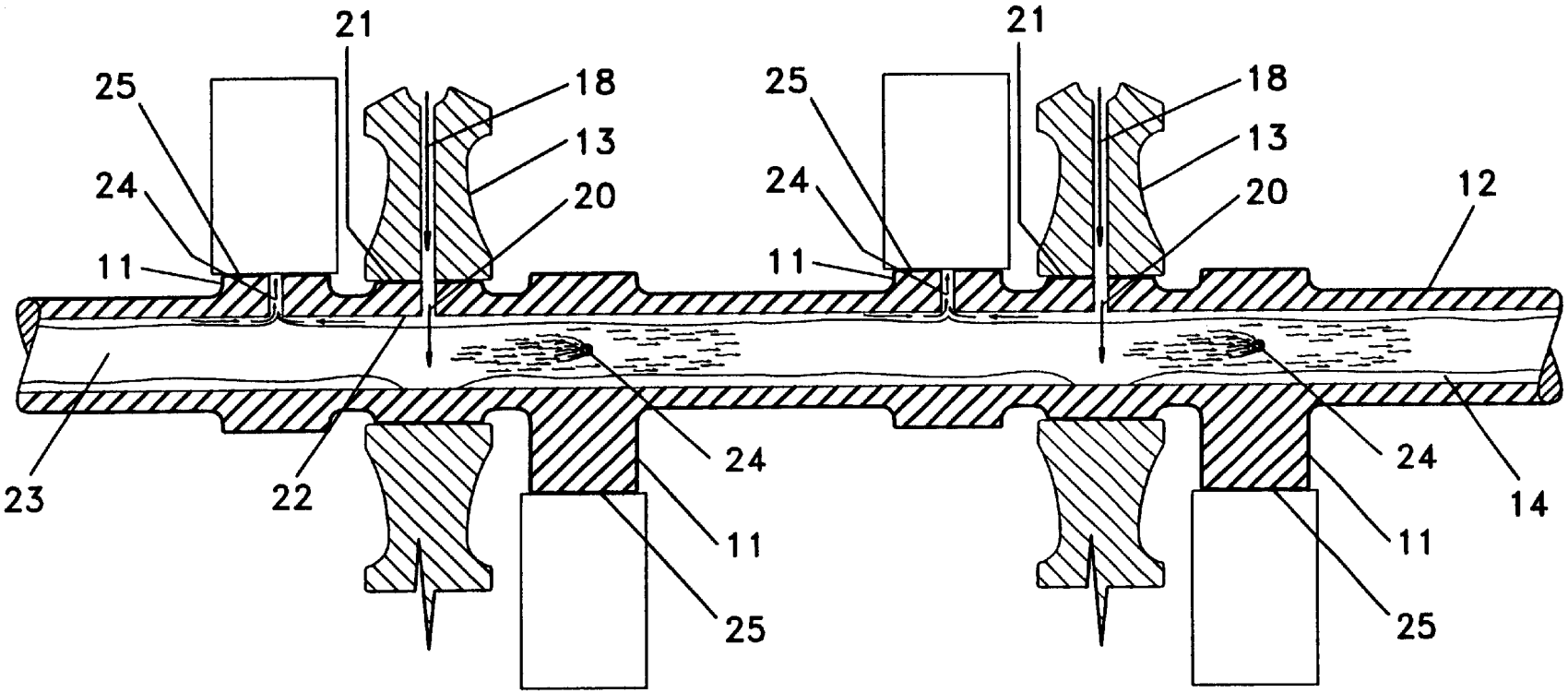
FIG. 2 shows a cross section of an embodiment of the camshaft lubrication invention rotationally journaled in a plurality of bearings.

Now referring primarily to FIG. 2, the camshaft lubrication system invention can comprise a plurality of bearing means (13) each of the bearing means (13) having a lubrication supply conduit (18). Lubricant (14) can be supplied to each of the lubrication supply conduits (18) from the lubricant reservoir (15) by pressurizing the lubricant with the lubricant pressurization element (16). A hollow camshaft (12) can be rotationally journaled to each of the plurality of bearing means (13) and a camshaft lubrication supply duct (20) can traverse each journal surface (21) and the interior surface (22) of the hollow camshaft (19). Each camshaft lubrication supply duct (20) can be rotatably aligned with a corresponding each lubrication supply conduit (18). During the period that the lubrication supply conduit (18) and the camshaft lubrication supply duct are fluidicly coupled lubricant can be transferred to the interior volume (23) of the hollow camshaft (12). The lubricant (14) can then migrate along the interior surface (22) of the hollow camshaft 12. Each cam lobe (11) can have a cam surface lubrication supply duct (24) that traverses the cam surface (25) and the interior surface (22) of the hollow camshaft (12). The lubricant (14) migrating along the interior surface (22) of the hollow camshaft (12) can enter each cam surface lubrication supply duct (24) and can be delivered to the corresponding cam surface (25).

By providing a camshaft lubrication supply duct (18) at each journaled surface (21) lubricant can be delivered to each cam surface lubrication supply duct (24) even when the hollow camshaft (12) is operated out of horizontal. As such, utilizing the invention, lubricant (14) can be delivered to each of the cam surfaces (25) even when an aircraft has a pitch of 5 degrees, 10 degrees, 15 degrees, 20 degrees, or even greater pitch. As can be understood, the diameter of the lubrication supply conduit (18) and the diameter of the camshaft lubrication supply ducts (20) traversing each journal to the interior surface (22) of the hollow camshaft (12) can be varied depending on the application. In some applications, a plurality of camshaft lubrication supply ducts (20) can traverse on each journal surface (21) and the interior surface of the hollow camshaft (12).

For example, specifically when modifying a Lycoming engine camshaft (Part No. 535661), the camshaft lubrication supply ducts (20) and the cam surface lubrication supply ducts (24) can be about one-sixteenth of an inch. See, Firewall Forward Technologies Technical Report No. 4, hereby incorporated by reference herein. In aircraft engine applications, where the amount of lubricant (14) available and the size of the lubricant pressurization element (16) may be limited it may be necessary to consider the amount of lubricant that can be delivered to the interior volume of the hollow camshaft (12) while maintaining normal oil pressure. See, Firewall Forward Technologies Technical Report No. 2, hereby incorporated by reference herein. While this particular example of an embodiment of the invention illustrates the use of the invention in Lycoming aircraft engines, the invention can also be used in other types of aircraft engines, as well as, automobile engines, marine engines, motorcycle engines, or the like.

Figure 4:
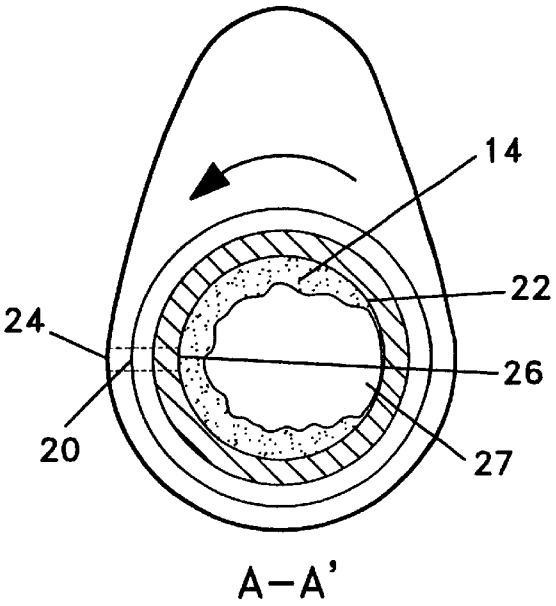
FIG. 4 provides cross section A—A indicated in FIG. 3.
Figure 3:
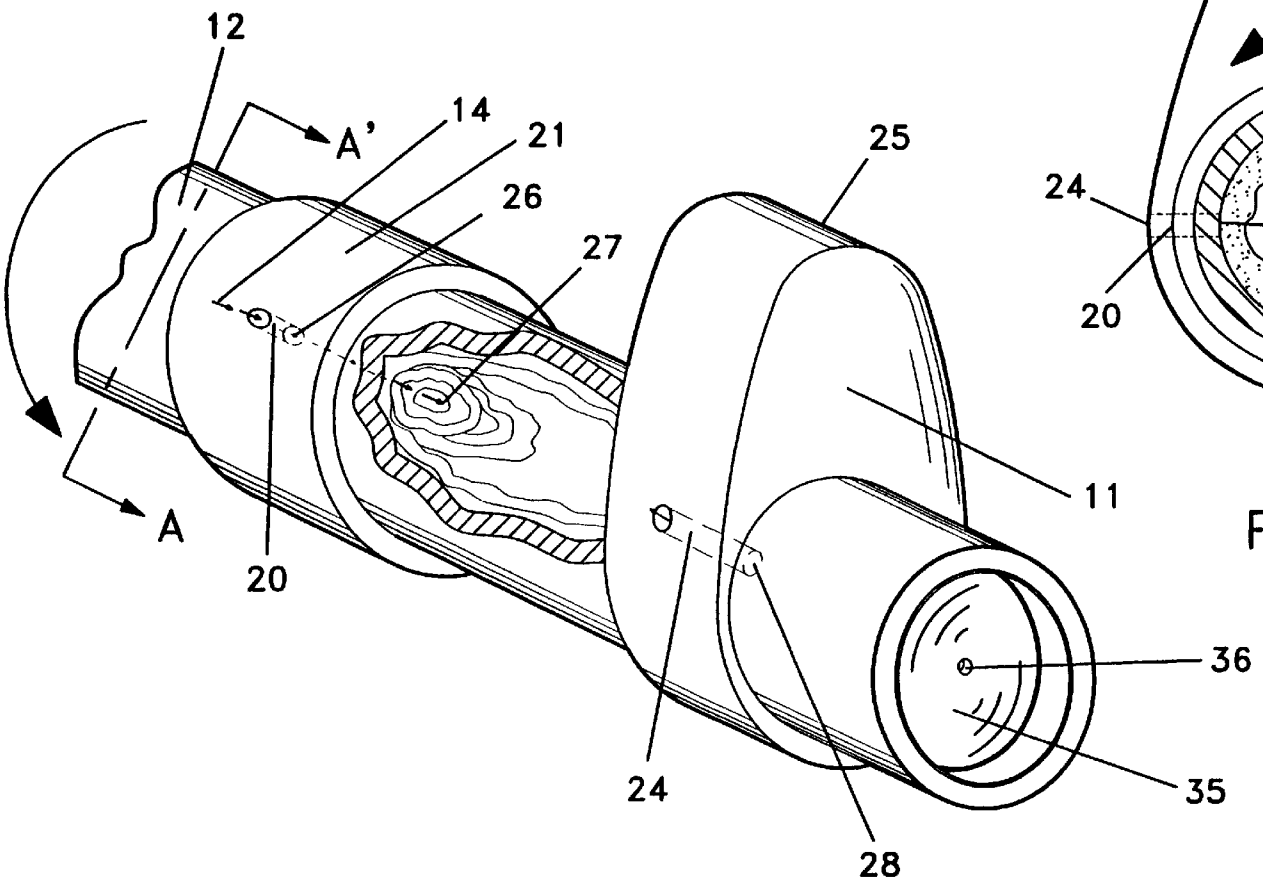
FIG. 3 shows a cut away of an embodiment of the camshaft lubrication invention having an angular displacement of the camshaft lubrication supply duct and the cam surface lubrication supply duct of less than 30 degrees.

Now referring primarily to FIGS. 3 and 4, a particular embodiment of the invention provides the proper angular displacement between the camshaft lubrication supply duct (s) (20) and the cam surface lubrication supply duct(s) (24). As can be understood from FIG. 8, when a lubrication supply conduit (18) and a camshaft lubrication supply duct (20) are aligned lubricant (14) can be propelled from the camshaft lubrication supply duct aperture (26) with sufficient force to create an lubricant pressure gradient (27) on the interior surface (22) of the hollow shaft 12 opposite the camshaft lubrication supply duct aperture (26). The lubricant pressure gradient (27) can be sufficient to prevent or impede the migration of oil over a portion of the interior surface (22) of the hollow camshaft (12). If a cam surface lubrication supply duct (24) has an aperture (28) on the interior surface (22) of the hollow camshaft (12) within this area of high pressure, lubricant may not flow to the cam surface lubrication supply duct aperture(s) (28).

As shown primarily by FIGS. 3 and 4, particular embodiments of the invention may comprise a plurality of bearing means (13) in which a hollow camshaft (12) is journaled. A single cam lobe (11) can have a position adjacent to a journal surface (21) on the hollow camshaft (12). In the case of a single cam lobe (11) adjacent to a journaled surface (21), where the camshaft lubrication supply duct aperture (26) has a location on the interior surface (22) of the hollow camshaft (12) and the cam surface lubrication supply duct aperture (28) has a location on the interior surface (22) of the hollow camshaft (12), the angular displacement of the camshaft lubrication supply duct aperture (26) and the cam surface lubrication supply duct aperture can be between about zero degrees and thirty degrees. In this manner, the pressure dam created by the lubricant pressure gradient (27) can have little if no effect on the flow of lubricant (14) to the cam surface lubrication supply duct aperture (28).

Figure 5:
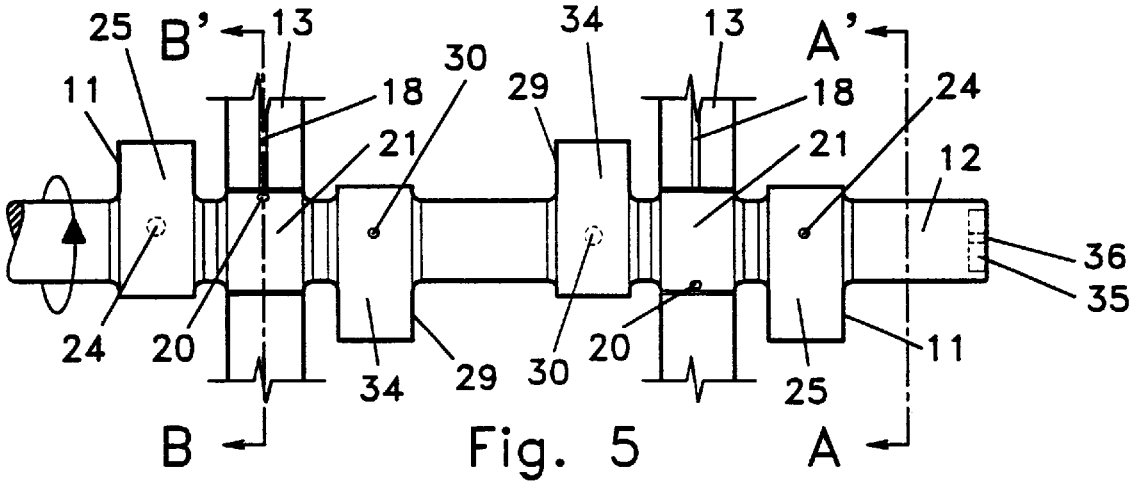
FIG. 5 shows an embodiment of the camshaft lubrication invention having the angle of displacement between the two cam surface lubrication supply ducts proximate to the journaled surface approximately bisected by the location of the camshaft lubrication supply duct.
Figure 6:
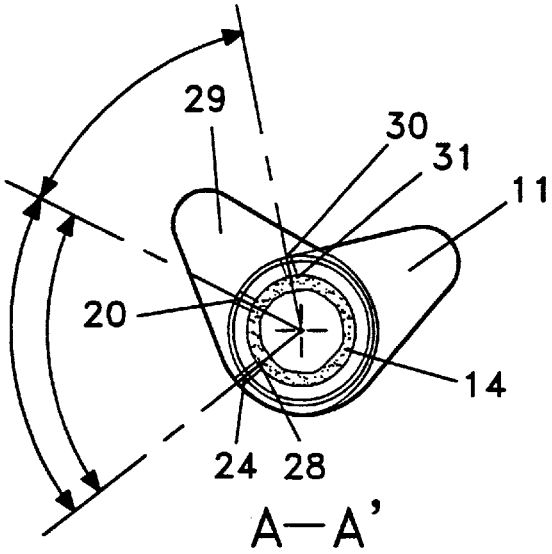
FIG. 6 provides cross section A—A indicated in FIG. 5.
Figure 7:
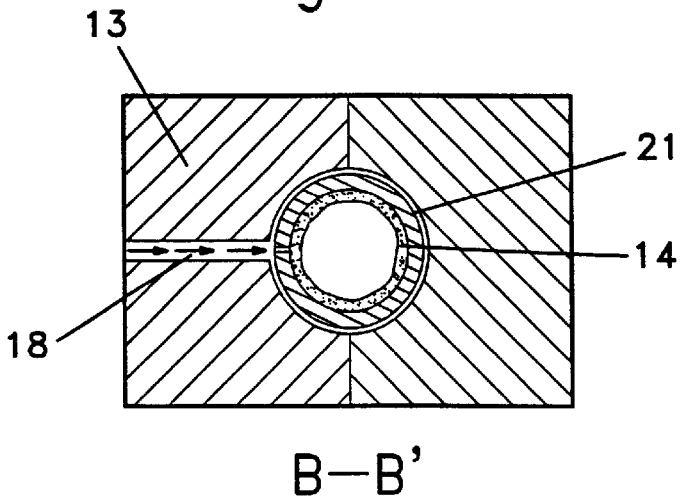
FIG. 7 provides cross section B—B indicated in FIG. 5.

Now referring primarily to FIGS. 5 through 7, particular embodiments of the invention can comprise a plurality of bearing means (13) in which a hollow camshaft (12) can be journaled. A first cam lobe (11) can have a position adjacent to a camshaft journal surface (21) of a hollow camshaft (19) and have a cam surface lubrication supply duct (24) with an aperture (28) having a first location on the interior surface (22) of the hollow camshaft (12). A second cam lobe (29) can have a position on the opposite side of the same camshaft journal (21) and have a second cam surface lubrication supply duct (30) having an aperture (31) having a second location on the interior surface (22) of the hollow camshaft (12). In this case, the camshaft lubrications supply duct (20) can have an angular displacement that approximately bisects the smaller angle of displacement defined by the location of the first cam surface lubrication supply duct aperture (30) and the second cam surface lubrication supply duct aperture (28). See FIG. 4, cross section A–A', for an example of a particular embodiment of the invention.

In certain applications there may be additional cam lobes adjacent to either the first cam lobe (11) or the second cam lobe (11), or both. Inmost applications, the location of the cam surface lubrication supply duct apertures corresponding to these additional lobes need not be considered as the pressure dam resulting from the lubricant pressure gradient (27) does not effect the migration of the lubricant (14) on the interior surface (22) of the hollow camshaft (12) beyond the distance of the first cam lobe on either side of the corresponding journal surface (21).

Figure 8:
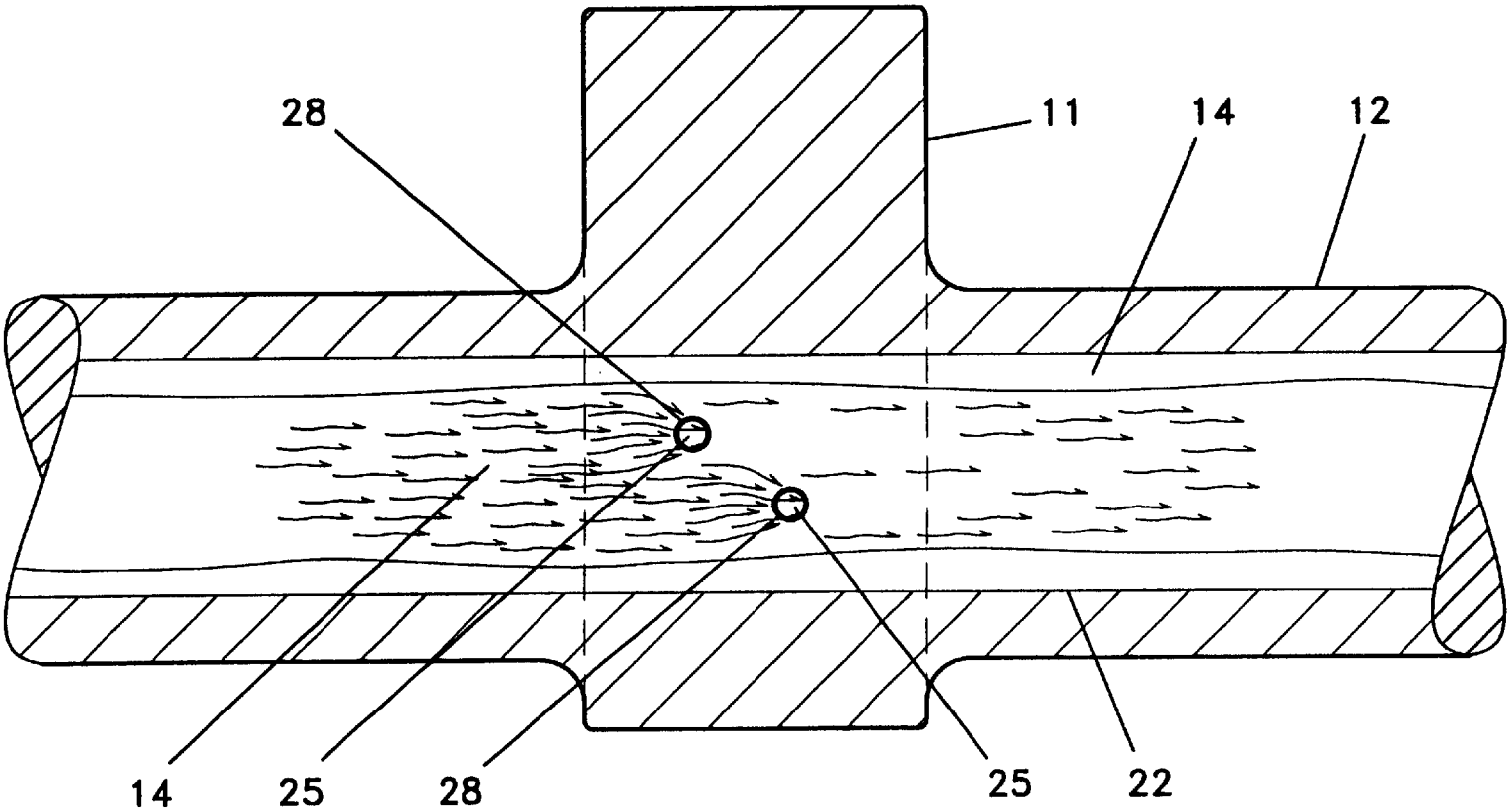
FIG. 8 shows a cut away of an embodiment of the camshaft invention which provides multiple staggered cam surface lubrication supply ducts utilizing two different portions of the lubricant fluid stream.
Figure 9:
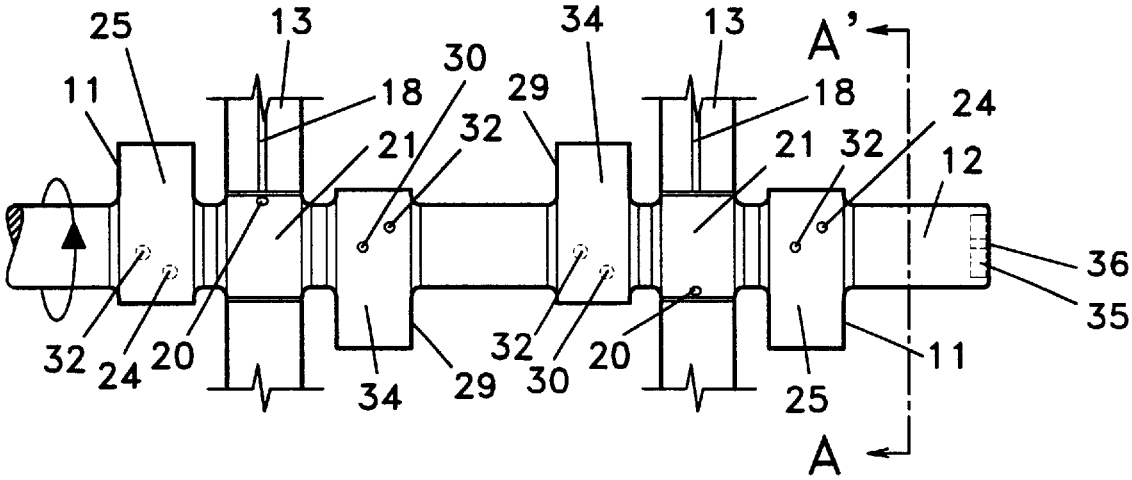
FIG. 9 shows a side view of an embodiment of the camshaft invention which provides multiple staggered cam surface lubrication supply ducts utilizing two different portions of the lubricant fluid stream.
Figure 10:
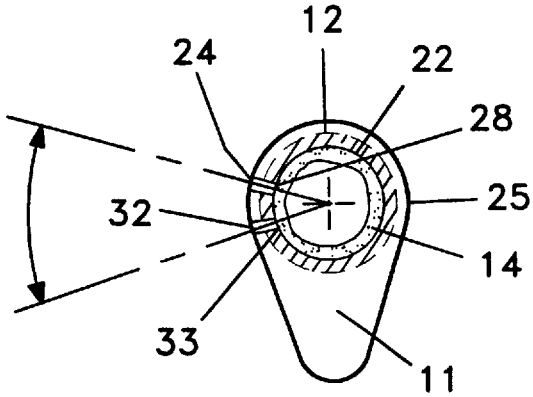
FIG. 10 provides cross section A—A indicated in FIG. 9.

Now referring primarily to FIGS. 8 through 10, certain embodiments of the invention provide at least two (or multiple) cam surface lubrication supply ducts (24)(32). As can be understood from FIG. 8, lubricant (14) migrates to the cam surface supply duct aperture (28) located on the interior surface (22) of a hollow camshaft (12) enters the cam surface supply duct aperture (28) and travels to the cam surface (25). Migration of lubricant (14) can be reduced or there may be no migration of lubricant (14) down stream of each lubrication supply duct aperture. As such, a second cam surface supply duct aperture (28) located to take advantage of the same lubricant stream as the first cam surface supply duct aperture (i.e. having a location directly downstream of the first cam surface supply duct aperture) may receive a reduced amount or may not receive any amount of lubricant (14) to transfer to the cam surface (11).

Now referring primarily to FIGS. 9 and 10, certain embodiments of the invention can comprise a plurality of bearing means (13) in to which a hollow camshaft (12) is journaled. A cam lobe (11) can have a position on the hollow camshaft (12). The cam lobe (11) can further comprise a first cam surface lubrication supply duct (24) with an aperture (28) having a first location on the interior surface (22) of the hollow camshaft (12). The cam lobe (11) can further comprise a second cam surface lubrication supply duct (32) with an aperture (28) having a second location on the interior surface (22) of the hollow camshaft (12).

With respect to some embodiments of the invention, the location of the first cam surface lubrication supply duct aperture (28) on the interior surface (22) of the hollow camshaft (12) and the second cam surface lubrication supply duct aperture (33) on the interior surface (22) of the hollow camshaft (12) can have a angular displacement. With respect to particular embodiments of the invention for aircraft engines, two cam surface lubrication supply ducts can have a angular displacement defined by a distance between the circumferences of the respective apertures equivalent to about one diameter of the cam surface lubrication supply duct aperture (28).

Now referring primarily to FIGS. 5 and 9, it can be understood that certain embodiments of the invention can provide cam surface supply ducts (24)(30)(32) that are differentially configured to supply differential amounts of lubricant to each of a plurality of cam surfaces (25)(34) to substantially equalize the amount of wear to such plurality of cam surfaces. With respect to certain camshafts, the failure rate of one or more of the cam lobes within a plurality of cam lobes (11) of a hollow camshaft (12) can have a statistically higher failure rate than the other cam lobes within the plurality. By enlarging the diameter of the cam surface supply ducts corresponding to those cam lobes having statistically higher failure rates the wear to these cam lobes can be made substantially equal to the failure rates of the other cam lobes.

Again referring to FIG. 3, certain embodiments of the invention can further comprise an hollow camshaft end seal (35). The hollow camshaft end seal (35) can comprise a freeze plug or other suitable seal device that can be pressed into both ends of the hollow camshaft (12) to prevent lubricant from migrating from either hollow camshaft end. The hollow camshaft end seal (35) at the forward end of the hollow camshaft can have a vent hole (36) (for many applications about one-sixteenth inch diameter) that traverses the exterior surface to the interior surface of the hollow camshaft end seal (35). The vent hole (36) can have a location at the rotation axis of the hollow camshaft (12). The vent hole (36) can allow disruption or impediments to lubricant (14) flow through the cam surface supply ducts (24)(30)(32) can be reduced.

Importantly, with respect to embodiments of the invention that use hardened camshafts, it may be preferred to drill the camshaft lubrication supply ducts (20) and the cam surface lubrication supply ducts (24)(30)(32) using electrical discharge machining technology. Alternately, a slow feed rate carbide drill bit may be used as disclosed by Firewall Forward Technologies Technical Report No. 6 and 7, hereby incorporated by reference herein.

What is claimed is:

1. A method of lubricating a camshaft, comprising the steps of:

a. supplying lubricant to a plurality of bearing means each having a corresponding lubrication supply conduit;

b. rotating a hollow camshaft having a single internal lubrication passage rotationally journaled to said bearing means to align at least one camshaft lubrication supply duct with each said lubrication supply conduit, wherein said at least one camshaft lubrication supply duct traverses between a journal surface of said hollow camshaft and said single internal lubrication passage of said hollow camshaft; and c. supplying lubricant to said single internal lubrication passage of said hollow camshaft through each of said at least one lubrication supply duct; and d. rotationally displacing said camshaft lubrication supply duct and a cam surface lubrication supply duct between about zero degrees and thirty degrees about the rotation axis of said hollow camshaft, wherein said cam surface lubrication supply duct traverses between a cam surface of a first cam lobe adjacent to said journal surface of said hollow camshaft.

2. A method of lubricating a camshaft as described in claim 1, further comprising the step of approximately bisecting the rotational displacement of said cam surface lubrication supply duct on said first cam lobe adjacent to said journal surface of said hollow camshaft and a cam surface lubrication supply duct on a second cam lobe adjacent to said journal surface of said hollow camshaft with the location of said camshaft lubrication supply duct.

3. A method of lubricating a camshaft as described in claim 2, further comprising the steps of traversing said first cam lobe with a second cam surface lubrication supply duct.

4. A method of lubricating a camshaft as described in claim 3, further comprising the step of angularity displacing said cam surface lubrication supply duct and said second cam surface lubrication supply duct about the rotation axis of said camshaft an amount equal to about one aperture diameter of said cam surface lubrication supply duct.

5. A method of lubricating a camshaft as described in claim 4, further comprising the step of differentially configuring each said cam surface lubrication duct to supply an amount of lubricant sufficient to equalize wear of a plurality of cam surfaces.

6. A method of lubricating a camshaft as described in claim 5, further comprising the step of sealing each end of said hollow camshaft.

7. A method of lubricating a camshaft as described in claim 6, further comprising the step of ventilating said hollow camshaft, wherein ventilating said hollow camshaft comprises the step of traversing between a camshaft end seal exterior surface and a camshaft end seal interior surface with a hole.

8. A method of lubricating a camshaft as described in claims 1, 2, 3, 4 and 5, further comprising the step of utilizing said hollow camshaft in an engine.

9. A method of lubricating a camshaft as described in claim 8, further comprising the step of operating said camshaft in said engine from horizontal.

10. A method of lubricating a camshaft as described in claim 9, wherein said step of operating said camshaft in said engine from horizontal comprises operating said camshaft at a pitch selected from the group consisting of 5 degrees, 10 degrees, 15, degrees, and 20 degrees.

* * * * *